US009528799B2

(12) United States Patent
Maljkovic

(10) Patent No.: US 9,528,799 B2
(45) Date of Patent: Dec. 27, 2016

(54) NECK POLYMERIC AMMUNITION CASING GEOMETRY

(71) Applicant: MAC LLC, Bay St. Louis, MS (US)

(72) Inventor: Nikica Maljkovic, New Orleans, LA (US)

(73) Assignee: MAC LLC, Bay St. Louis, MS (US)

( * ) Notice: Subject to any disclaimer, the term of this patent is extended or adjusted under 35 U.S.C. 154(b) by 0 days.

(21) Appl. No.: 14/596,032

(22) Filed: Jan. 13, 2015

(65) Prior Publication Data

US 2015/0316361 A1 Nov. 5, 2015

Related U.S. Application Data

(60) Provisional application No. 61/926,795, filed on Jan. 13, 2014.

(51) Int. Cl.
*F42B 5/30* (2006.01)
*F42B 5/02* (2006.01)

(52) U.S. Cl.
CPC *F42B 5/30* (2013.01); *F42B 5/025* (2013.01)

(58) Field of Classification Search
CPC ..... F42B 5/26; F42B 5/30; F42B 5/307; F42B 5/313
USPC ..... 102/464, 465, 466, 467
See application file for complete search history.

(56) References Cited

U.S. PATENT DOCUMENTS

| | | | |
|---|---|---|---|
| 2,455,080 | A | 11/1948 | Miller |
| 3,060,856 | A | 10/1962 | Dunn |
| 3,144,827 | A | 8/1964 | Boutwell |
| 3,175,901 | A | 3/1965 | Jesmont et al. |
| 3,485,170 | A | 12/1969 | Scanlon |
| 3,609,904 | A | 10/1971 | Scanlon |
| 3,675,576 | A | 7/1972 | Whitney |
| 3,745,924 | A | 7/1973 | Scanlon |
| 3,749,023 | A | 7/1973 | Kawaguchi et al. |
| 3,989,017 | A | 11/1976 | Reece |
| 3,989,792 | A | 11/1976 | San Miguel |
| 3,990,366 | A | 11/1976 | Scanlon |
| 4,065,437 | A | 12/1977 | Blinne et al. |
| 4,108,837 | A | 8/1978 | Johnson et al. |
| 4,147,107 | A | 4/1979 | Ringdal |
| 4,157,684 | A | 6/1979 | Clausser |
| 4,175,175 | A | 11/1979 | Johnson et al. |
| 4,228,218 | A | 10/1980 | Takayanagi et al. |
| 4,308,847 | A | 1/1982 | Ruizzo |
| 4,326,462 | A | 4/1982 | Garcia et al. |
| 4,565,131 | A | 1/1986 | Buchner |
| 4,569,288 | A | 2/1986 | Grelle et al. |
| 4,574,703 | A | 3/1986 | Halverson |

(Continued)

FOREIGN PATENT DOCUMENTS

| | | | |
|---|---|---|---|
| DE | 2705235 | A1 | 8/1978 |
| DE | 4015542 | A1 | 11/1991 |

(Continued)

OTHER PUBLICATIONS

International Search Report and Written Opinion for International Application PCT/US2015/0011238, Completed Sep. 1, 2015, Mailed Sep. 30, 2015, 10 pgs.

(Continued)

*Primary Examiner* — Bret Hayes

(57) ABSTRACT

Ammunition casings that have optimal external cartridge dimensions for polymeric cases are provided. Polymeric ammunition cartridges and casings are presented having a neck portion of the polymeric case dimensioned for optimal fit within a firearm chamber. The polymeric ammunition casing may include one or both of an extended neck region and an internal cannelure engaging portion.

15 Claims, 4 Drawing Sheets

(56) References Cited

U.S. PATENT DOCUMENTS

| | | | |
|---|---|---|---|
| 4,614,157 | A | 9/1986 | Grelle et al. |
| 4,711,271 | A | 12/1987 | Weisenbarger et al. |
| 4,726,296 | A | 2/1988 | Leshner et al. |
| 4,809,612 | A | 3/1989 | Ballreich et al. |
| 4,839,435 | A | 6/1989 | Gergen et al. |
| 4,867,065 | A | 9/1989 | Kaltmann et al. |
| 4,897,448 | A | 1/1990 | Romance |
| 4,958,567 | A | 9/1990 | Olson |
| 4,969,386 | A | 11/1990 | Sandstrom et al. |
| 5,033,386 | A | 7/1991 | Vatsvog |
| 5,062,343 | A | 11/1991 | Sjoberg et al. |
| 5,129,382 | A | 7/1992 | Stamps et al. |
| 5,151,555 | A | 9/1992 | Vatsvog |
| 5,161,512 | A | 11/1992 | Adam et al. |
| 5,175,040 | A | 12/1992 | Harpell et al. |
| 5,190,018 | A | 3/1993 | Costello et al. |
| 5,196,252 | A | 3/1993 | Harpell |
| 5,227,457 | A | 7/1993 | Marrocco, III et al. |
| 5,259,288 | A | 11/1993 | Vatsvog |
| 5,404,913 | A | 4/1995 | Gilligan |
| 5,434,224 | A | 7/1995 | McGrail et al. |
| 5,471,905 | A | 12/1995 | Martin |
| 5,496,893 | A | 3/1996 | Gagne et al. |
| 5,512,630 | A | 4/1996 | Gagne et al. |
| 5,519,094 | A | 5/1996 | Tseng et al. |
| 5,539,048 | A | 7/1996 | Gagne et al. |
| 5,558,765 | A | 9/1996 | Twardzik |
| 5,565,543 | A | 10/1996 | Marrocco et al. |
| 5,585,450 | A | 12/1996 | Oaks et al. |
| 5,616,650 | A | 4/1997 | Becker et al. |
| 5,625,010 | A | 4/1997 | Gagne et al. |
| 5,637,226 | A | 6/1997 | Adam et al. |
| 5,646,231 | A | 7/1997 | Marrocco, III et al. |
| 5,646,232 | A | 7/1997 | Marrocco, III et al. |
| 5,654,392 | A | 8/1997 | Marrocco, III et al. |
| 5,659,005 | A | 8/1997 | Marrocco, III et al. |
| 5,668,245 | A | 9/1997 | Marrocco et al. |
| 5,670,564 | A | 9/1997 | Gagne et al. |
| 5,691,401 | A | 11/1997 | Morita et al. |
| 5,721,335 | A | 2/1998 | Marrocco, III et al. |
| 5,731,400 | A | 3/1998 | Marrocco, III et al. |
| 5,755,095 | A | 5/1998 | Maurer |
| 5,756,581 | A | 5/1998 | Marrocco, III et al. |
| 5,760,131 | A | 6/1998 | Marrocco, III et al. |
| 5,770,815 | A | 6/1998 | Watson |
| 5,789,521 | A | 8/1998 | Marrocco, III et al. |
| 5,822,904 | A | 10/1998 | Beal |
| 5,824,744 | A | 10/1998 | Gagne et al. |
| 5,827,527 | A | 10/1998 | Leonard |
| 5,827,927 | A | 10/1998 | Gagne et al. |
| 5,830,945 | A | 11/1998 | Gagne et al. |
| 5,869,592 | A | 2/1999 | Gagne et al. |
| 5,886,130 | A | 3/1999 | Trimmer et al. |
| 5,976,437 | A | 11/1999 | Marrocco, III et al. |
| 6,087,467 | A | 7/2000 | Marrocco, III et al. |
| 6,135,097 | A | 10/2000 | Ruizzo, Jr. et al. |
| 6,228,970 | B1 | 5/2001 | Savariar |
| 6,283,035 | B1 | 9/2001 | Olson et al. |
| 6,367,441 | B1 | 4/2002 | Hoshiba et al. |
| 6,387,985 | B1 | 5/2002 | Wilkinson et al. |
| 6,441,099 | B1 | 8/2002 | Connell et al. |
| 6,525,125 | B1 | 2/2003 | Giardello et al. |
| 6,528,145 | B1 | 3/2003 | Berger et al. |
| 6,586,554 | B1 | 7/2003 | Takahashi |
| 6,630,538 | B1 | 10/2003 | Ellul et al. |
| 6,752,084 | B1 | 6/2004 | Husseini et al. |
| 6,845,716 | B2 | 1/2005 | Husseini et al. |
| 7,610,858 | B2 | 11/2009 | Chung |
| 7,992,498 | B2 | 8/2011 | Ruhlman et al. |
| 8,240,252 | B2 | 8/2012 | Maljkovic et al. |
| 8,408,137 | B2 | 4/2013 | Battaglia |
| 8,443,730 | B2 | 5/2013 | Padgett |
| 8,561,543 | B2 | 10/2013 | Burrow |
| 8,763,535 | B2 | 7/2014 | Padgett |
| 8,813,650 | B2 | 8/2014 | Maljkovic et al. |
| 8,869,702 | B2 | 10/2014 | Padgett |
| 9,032,855 | B1 | 5/2015 | Foren et al. |
| 9,182,204 | B2 | 11/2015 | Maljkovic et al. |
| 9,188,412 | B2 | 11/2015 | Maljkovic et al. |
| 9,335,137 | B2 | 5/2016 | Maljkovic et al. |
| 9,395,165 | B2 | 7/2016 | Maljkovic et al. |
| 2001/0013299 | A1 | 8/2001 | Husseini et al. |
| 2002/0035946 | A1 | 3/2002 | Jamison et al. |
| 2003/0019385 | A1 | 1/2003 | LeaSure et al. |
| 2003/0131751 | A1 | 7/2003 | MacKerell et al. |
| 2003/0181603 | A1 | 9/2003 | Venderbosch et al. |
| 2004/0096539 | A1 | 5/2004 | McCaffrey et al. |
| 2004/0211668 | A1 | 10/2004 | Montminy et al. |
| 2005/0005807 | A1 | 1/2005 | Wiley et al. |
| 2005/0016414 | A1* | 1/2005 | Leitner-Wise ..... F42B 5/025 102/522 |
| 2005/0049355 | A1 | 3/2005 | Tang et al. |
| 2005/0066805 | A1 | 3/2005 | Park et al. |
| 2005/0188879 | A1 | 9/2005 | Wiley et al. |
| 2006/0013977 | A1 | 1/2006 | Duke et al. |
| 2006/0056958 | A1 | 3/2006 | Gaines et al. |
| 2006/0069236 | A1 | 3/2006 | Brunelle et al. |
| 2006/0102041 | A1 | 5/2006 | Wiley et al. |
| 2006/0105183 | A1 | 5/2006 | Chu et al. |
| 2006/0207464 | A1 | 9/2006 | Maljkovic et al. |
| 2007/0172677 | A1 | 7/2007 | Biermann et al. |
| 2007/0261587 | A1 | 11/2007 | Chung |
| 2008/0017026 | A1 | 1/2008 | Dondlinger et al. |
| 2009/0211483 | A1 | 8/2009 | Kramer et al. |
| 2010/0016518 | A1 | 1/2010 | El-Hibri et al. |
| 2010/0282112 | A1 | 11/2010 | Battaglia |
| 2011/0214583 | A1* | 9/2011 | Dutch ..... F42B 5/025 102/464 |
| 2012/0052222 | A1 | 3/2012 | Gagne |
| 2012/0111219 | A1 | 5/2012 | Burrow et al. |
| 2012/0180687 | A1 | 7/2012 | Padgett et al. |
| 2012/0180688 | A1 | 7/2012 | Padgett |
| 2013/0014664 | A1 | 1/2013 | Padgett et al. |
| 2013/0014665 | A1 | 1/2013 | Maljkovic et al. |
| 2013/0186294 | A1 | 7/2013 | Davies et al. |
| 2014/0060372 | A1 | 3/2014 | Padgett et al. |
| 2014/0060373 | A1 | 3/2014 | Maljkovic et al. |
| 2014/0076188 | A1 | 3/2014 | Maljkovic et al. |
| 2014/0290522 | A1 | 10/2014 | Padgett et al. |
| 2015/0033970 | A1 | 2/2015 | Maljkovic et al. |
| 2015/0047527 | A1 | 2/2015 | Padgett |
| 2015/0285604 | A1 | 10/2015 | Bosarge et al. |
| 2016/0025464 | A1 | 1/2016 | Maljkovic et al. |
| 2016/0040970 | A1 | 2/2016 | Maljkovic et al. |
| 2016/0216088 | A1 | 7/2016 | Maljkovic et al. |

FOREIGN PATENT DOCUMENTS

| | | | |
|---|---|---|---|
| EP | 222827 | B1 | 5/1991 |
| EP | 436111 | A2 | 7/1991 |
| FR | 861071 | A | 1/1941 |
| GB | 672706 | A | 5/1952 |
| GB | 732633 | A | 6/1955 |
| GB | 1568545 | A | 5/1980 |
| WO | 8300213 | A1 | 1/1983 |
| WO | 8606466 | A1 | 11/1986 |
| WO | 8907496 | A1 | 8/1989 |
| WO | 9207024 | A1 | 4/1992 |
| WO | 9513516 | A1 | 5/1995 |
| WO | 9839250 | A1 | 9/1998 |
| WO | 2008090505 | A2 | 7/2008 |
| WO | 2013016730 | A1 | 1/2013 |
| WO | 2015130409 | A2 | 9/2015 |
| WO | 2015154079 | A1 | 10/2015 |

OTHER PUBLICATIONS

International Preliminary Report on Patentability for International Application PCT/US2015/011238, issued Jul. 19, 2016, Mailed Jul. 29, 2016, 2016, 9 Pgs.

International Search Report and Written Opinion for International Application No. PCT/US2008/072810, completed Oct. 19, 2008, 9 pgs.

(56) References Cited

OTHER PUBLICATIONS

International Search Report and Written Opinion for International Application PCT/US2015/024528, Completed Jun. 16, 2015, Mailed Jul. 8, 2015, 7 pgs.
IPRP for International Application No. PCT/US2012/048848, Search Completed Jan. 28, 2014, 7 pgs.
Extended European Search Report for European Application EP12817294.7, Report completed Aug. 12, 2014, Mailed Aug. 19, 2014, 7 Pgs.
"A Guide to Polycarbonate in General", Engineering Polymer Specialists Polymer Technology & Services, LLC, pp. 1-5.
"Development Product Makrolon® DPI-1848, Polycarbonate Copolymer Resin General Purpose Grade", Bayer Polymers, May 2003, pp. 1-4.
"GE Plastics, Lexan® EXL9330 Americas: Commercial", General Electric Company, Sep. 29, 2004, pp. 1-5.
International Search Report and Written Opinion for International Application PCT/US2012/048848, completed Oct. 12, 2012, 8 pgs.
"Low Temperature Notched Izod Impact of RADEL R-5xxx Resins", File No. 2803, Solvay Advanced Polymers, L.L.C., Jan. 7, 1999, 1 pg.
"Preliminary Product Data, RTP 1899A X 83675 Polycarbonate/Acrylic Alloy (PC/PMMA) Thin Wall Grade", RTP Company Product Data Sheet, available at http://www.rtpcompany.com/info/data/1800A/RTP1899AX83675.htm, printed, Mar. 7, 2005, 5 pgs.
"Standard Test Methods for Determining the Izod Pendulum Impact Resistance of Plastics,1", ASTM Designation: D256-00, Jan. 2001, pp. 1-19.
Baldwin et al., "A microcellular processing study of poly(ethylene terephthalate) in the amorphous and semicrystalline states. Pat I : microcell nucleation", Society of Plastics Engineers, Polymer Engingeering and Science (1996), vol. 36 (11), pp. 1437-1445.
Naitove, "Self-reinforcing thermoplastic is harder, stronger, stiffer without added fibers", Plastics Technology, Gardner Publication Inc., Jul. 2003, 2 pgs.

* cited by examiner

--Prior Art--

NECK POLYMERIC AMMUNITION CASING GEOMETRY

CROSS-REFERENCE TO RELATED APPLICATIONS

The current application claims priority to U.S. Provisional App. No. 61/926,795, filed Jan. 13, 2014, the disclosure of which is incorporated herein by reference.

FIELD OF THE INVENTION

Disclosures of ammunition casings are provided, including ammunition casing having dimensional profiles optimized for polymeric ammunition.

BACKGROUND OF THE INVENTION

Ammunition and the firearm that the ammunition is used in have to function together. In order to facilitate this, dimensions of ammunition and the firearm chambers that it has to function in are very tightly dimensionally controlled. A variety of organizations exist that provide standards in order to help assure smooth functioning of all ammunition in all weapons. Non-limiting examples of these organizations include the Sporting Arms and Ammunition Manufacturers' Institute (SAAMI) in USA, the Commission Internationale Permanente pour l'épreuve des armes à feu portatives (CIP) in Europe, as well as various militaries around the globe ans transnational organizations such as the North Atlantic Treaty Organization (NATO).

SAAMI is the preeminent North American organization maintaining and publishing standards for dimensions of ammunition and firearms. Typically, SAAMI and other regulating agencies will publish two drawings, one that shows the minimum (MIN) dimensions for the chamber (i.e. dimensions that the chamber cannot be smaller than), and one that shows the maximum (MAX) ammunition external dimensions (i.e. dimensions that the ammunition cannot exceed). The MIN chamber dimension is always larger than the MAX ammunition dimension, assuring that the ammunition round will fit inside the weapon chamber. All published SAAMI, NATO, US Department of Defense (US DOD) and CIP drawings are incorporated here by reference.

It is important to note that SAAMI compliance and standardization is voluntary. SAAMI does not regulate all possible calibers, especially those for which the primary use is military (for example, .50 BMG (12.7 mm) calibers are maintained by the US DOD), or the calibers which have not yet been submitted (wildcat rounds, obscure calibers, etc.)

In general, new cases developed for established calibers (for which chamber/ammunition drawings are published) have to follow the published external dimensions very closely in order to function in the maximum number of weapons. This has also been true for development of cases with alternative case materials, such as for example polymers (see, e.g., U.S. Pat. Nos. 8,240,252 and 8,813,650, each of which are incorporated herein by reference). Polymer cases have been an active area of research for a number of years as they offer advantages in areas such as ammunition weight and accuracy. The current invention provides ammunition casings having dimensional profiles optimized for polymeric ammunition.

SUMMARY OF THE INVENTION

The disclosure is directed generally to ammunition casings being dimensioned and configured for manufacture by polymeric materials.

In some embodiments the polymeric ammunition casing includes:

a cylindrical hollow body defining an internal cavity formed at least partially of a polymeric material, the cylindrical hollow body further defining a longitudinal axis and having a closed primer end and an open projectile end, wherein the body is formed of a body portion proximal to the primer end and a neck portion proximal to the projectile end, and wherein the diameter of the cylindrical hollow body tapers such that the diameter of the body portion is larger than the diameter of the neck portion; and wherein the longitudinal length of the neck portion of the polymeric ammunition casing is greater than the longitudinal neck portion length of a conventional metal ammunition casing body of a comparable caliber.

In other embodiments the longitudinal length of the neck portion of the polymeric ammunition casing exceeds a maximum longitudinal neck portion length standard for an ammunition casing of comparable caliber as set by at least one ammunition standards organization. In some such embodiments the at least one ammunition standards organization is selected from the group of the Sporting Arms and Ammunition Manufacturers' Institute, the Commission Internationale Permanente pour l'épreuve des armes à feu portatives, the North Atlantic Treaty Organization, and the US Department of Defense. In other such embodiments, the longitudinal length of the neck portion of the polymeric ammunition casing exceeds a maximum longitudinal neck portion length standard for an ammunition casing of comparable caliber as set by at least one ammunition standards organization by at least 0.003 inches. In still other such embodiments, the longitudinal length of the neck portion of the polymeric ammunition casing exceeds a maximum longitudinal neck portion length standard for an ammunition casing of comparable caliber as set by at least one ammunition standards organization by from at least 0.020 inches. In yet other such embodiments, the longitudinal length of the neck portion of the polymeric ammunition casing exceeds a maximum longitudinal neck portion length standard for an ammunition casing of comparable caliber as set by at least one ammunition standards organization by from at least 0.050 inches.

In still other embodiments the longitudinal length of the neck portion of the polymeric ammunition casing is sufficient such that, when the ammunition casing is disposed within a firing chamber, the neck portion of the ammunition casing extends into the free bore portion of a firing chamber, but does not extend into the caliber-size portion of the firing chamber.

In yet other embodiments, the ammunition casing has a caliber selected from the group of .22, .22-250, .223, .243, .25-06, .264, .270, .277, .300, .30-30, .30-40, 30.06, .303, .308, .357, .38, .40, .44, .45, .45-70, .50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, and 40 mm.

In still yet other embodiments at least the neck portion and a portion of the body portion are formed of a polymeric material.

In still yet other embodiments the polymeric material is selected from the group consisting of siloxane-modified Bisphenol-A polycarbonates, polycarbonates containing biphenyl linkages, and polyphenylsulfones.

In still yet other embodiments the ammunition casing further includes a cylindrical strip of a polymeric material disposed within the internal cavity of the ammunition casing along at least a portion of the neck portion of said ammunition casing. In some such embodiments the cylindrical strip of polymeric material overlaps at least the portion of the neck portion of the ammunition casing that engages the cannelure of a projectile. In other such embodiments the hollow cylindrical strip is formed of the same polymeric material as the ammunition casing.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as exemplary embodiments of the invention and should not be construed as a complete recitation of the scope of the invention, wherein.

DETAILED DESCRIPTION OF THE INVENTION

Turning now to the drawings, polymeric ammunition casings dimensioned for optimal fit within a firearm chamber are provided. In many embodiments the polymeric ammunition casings have a neck portion elongated in comparison to conventional brass casings of a comparable caliber. In some embodiments, the elongated neck portion of the ammunition casing extends into the free bore of the firing chamber. In still other embodiments the neck portion of the ammunition casing extends at least 0.003" beyond the MAX recommended dimension for particular caliber to a maximum extension length at which the neck would engage the caliber-sized bore. In yet other embodiments the neck extension may be combined with a cylindrical shaped polymeric insert that protrudes into the internal cavity of the case.

Figure 1:
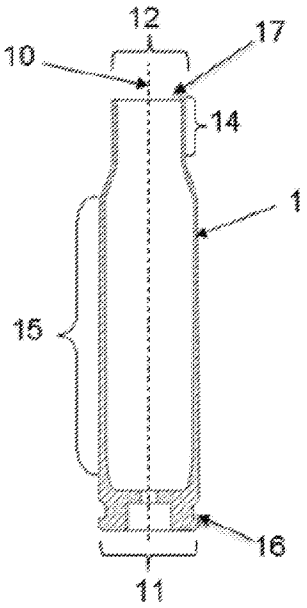
FIG. 1 provides a schematic of a conventional ammunition cartridge.

As shown in FIG. 1, a traditional cartridge casing (1) is a one-component deep-drawn hollow cylindrical article defining a longitudinal axis (10) along its length with a closed primer end (11) and an open projectile end (12). The overall body of the ammunition casing may be defined by two portions, a body portion proximal to the primer end and a neck portion proximal to the projectile end. (In the figure, the "neck" portion of the cartridge casing is designated as (14) while the "body" portion is designated as (15).) In many ammunition casing designs the diameter of the cylindrical body of the casing tapers from larger to smaller diameter between the body portion and the neck portion of the ammunition casing.

A weapon's cartridge chamber supports the majority of the cartridge casing wall in the radial direction, but, in many weapons, a portion of the cartridge base end (16) is unsupported. During firing, a stress profile is developed along the cartridge casing, the greatest stresses being concentrated in and around the base end. Therefore, the cartridge base end must possess the greatest mechanical strength, while a gradual decrease in material strength is acceptable in metal cartridges axially along the casing toward the end that receives the projectile (17). As discussed in the "Background" conventional brass cases and brass case manufacturers follow the recommended MAX dimensions set for by standard setting organizations like SAMMI, CIP, NATO and the US DOD. These dimensions also include specifications for other important cartridge attributes, such as headspace dimension, maximum diameters at various locations, hardness values, tolerances for all of the dimensions and possibly performance specifications such as peak chamber pressure, projectile velocities, action times, etc. It has now been discovered that the optimal external cartridge dimensions for polymeric cases differ quite significantly from the dimensions specified by the ammo/chamber specifications provided by the standard setting organizations. Accordingly, many embodiments are directed to ammunition casings configured specifically for polymeric materials.

Figure 2A:
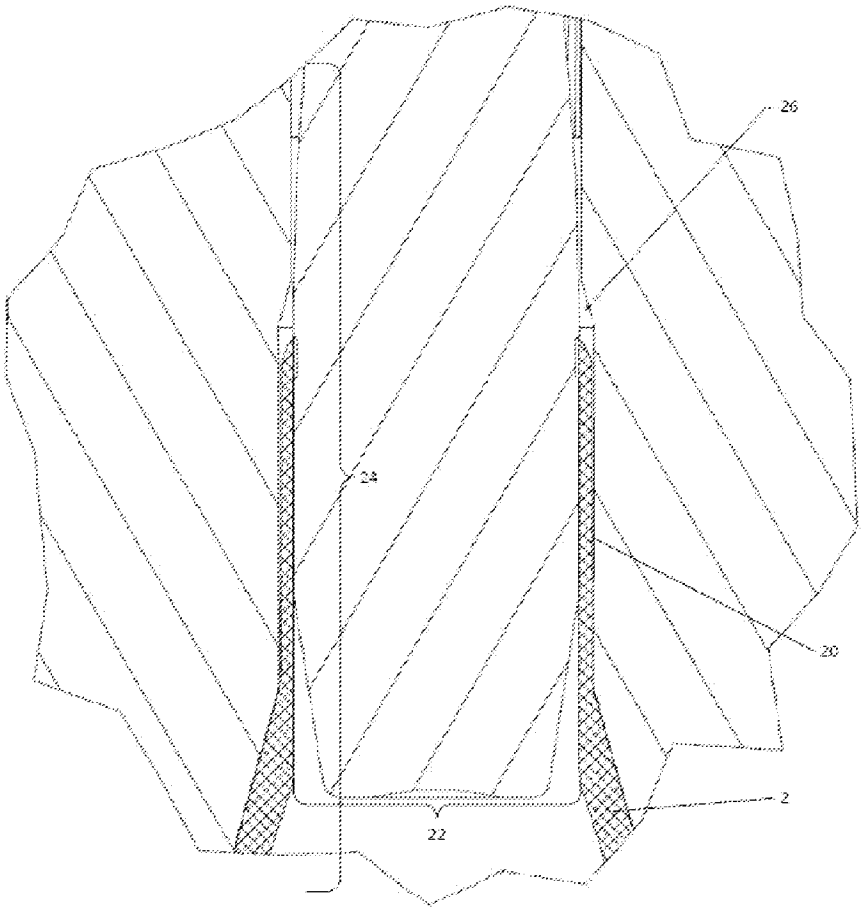
FIGS. 2*a* and 2*b* provide schematics of a polymeric ammunition casing incorporating traditional and extended neck regions in accordance with embodiments of the invention.
Figure 2B:
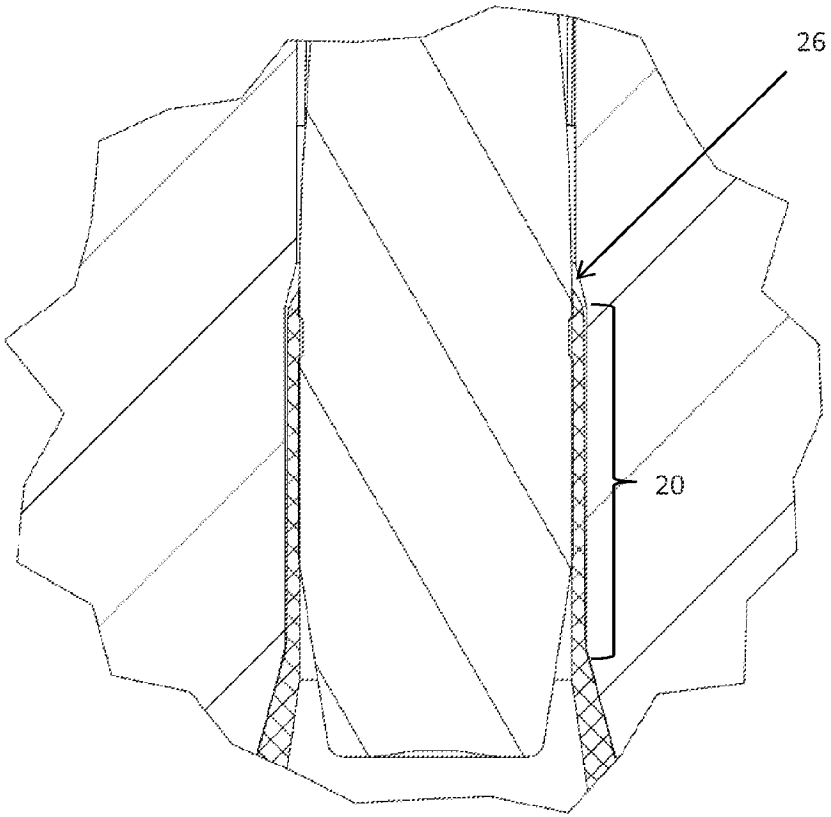

Many embodiments are directed to polymeric ammunition casings having a neck portion that is elongated longitudinally when compared to conventional brass ammunition cases. Exemplary embodiments of such polymeric ammunition casings having such elongated neck geometries are presented schematically in FIGS. 2*a* and 2*b*, where FIG. 2*a* shows a conventional casing for comparison and FIG. 2*b* shows a casing in accordance with embodiments of the invention. (It will be understood that the casings depicted in these drawings are schematic, i.e., they are not drawn to scale and all dimensions are approximate.)

There are many ways of quantifying the elongation of the neck region required to obtain optimal fit and integrity for polymeric casings. In some embodiments, as shown in FIGS. 2*a* and 2*b*, the neck portion (20) of the polymeric casings (2) may be compared to comparable calibers of conventional brass casings, and/or casing standards for such comparable calibers established by one or more standard setting bodies, such as, for example, SAMMI, CIP, NATO and/or US DOD. In such embodiments, the neck portion (20) is greater than the corresponding neck portion of a conventional brass casing of comparable caliber, in other embodiments the neck portion (20) exceeds the MAX dimension for the neck portion of a conventional casing of comparable caliber as established by one or more standard setting bodies. In some such embodiments, the neck portion (20) of the polymeric case is extended longitudinally a minimum of 0.003" beyond the MAX established dimensions for conventional brass rounds of comparable calibers up to a maximum elongation length where the casing would engage the caliber-sized bore region (22) of the firing chamber (24) where only the projectile (25) may insert and such where the casing would not be able to extend into, as shown in FIG. 2*b*, which can be compared with FIG. 2*a*.

Another way of establishing the relative lengths of ammunition casings is to describe their relative engagement within the firing chamber (24) of a weapon. In some embodiments, as shown in FIG. 2*b*, the neck portion (20) of the polymeric ammunition casing is elongated longitudinally such that neck portion extends into the "free bore" region (26) of the chamber. Having the neck portion of an ammunition casing extend into the free bore region of the firing chamber is contradictory to conventional teachings as traditional brass casings that extend into this "free bore" region tend to jam and cause major issues in the weapons. Polymeric ammunition with longer necks, in contrast, tend to perform much better than polymeric ammunition following the established standards, from both functional and integrity perspectives. For example, firing tests were conducted on .50 BMG polymeric ammunition casings having elongated neck regions, as set forth in embodiments, and .50 BMG polymeric ammunition casings having conventional neck dimensions in accordance with standards as established by the US DOD. In particular, a .50 BMG case drawing specifies the overall maximum case length as 3.910". However, improved function is obtained with polymeric cases when the overall case dimension is a minimum of 3.913" with all of the length extension being in neck portion (20). Moreover, it has been found that using a neck region dimension of 3.960" results in a neck integrity failure rate of below 1 in 10,000 (0.01%), while using the dimensions in the established US DOD standard result in a failure rate in excess of 1 in 200, a very high failure rate by ammunition standards that would render the ammunition unacceptable for most military applications.

Similar results were obtained in all the calibers tested, including 7.62 mm/0.308. The principle is operative for all cartridges that have the neck portions and all calibers. Many different types of ammunition articles are provided by the present invention. For example, polymeric cases that meet design guidelines of the invention may be used to produce ammunition components for various calibers of firearms. Non limiting examples include, for example, .22, .22-250, .223, .243, .25-06, .264, .270, .277, .300, .30-30, .30-40, 30.06, .303, .308, .357, .38, .40, .44, .45, .45-70, .50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, 40 mm and others. Accordingly, in many embodiments polymeric ammunition casings are provided having a neck region that is elongated by a minimum of 0.003" in a longitudinal direction. In other embodiments, the neck portion is longitudinally elongated by at least 0.020", and in yet other embodiments the neck portion is elongated by at least 0.050" in the longitudinal direction.

Figure 3:
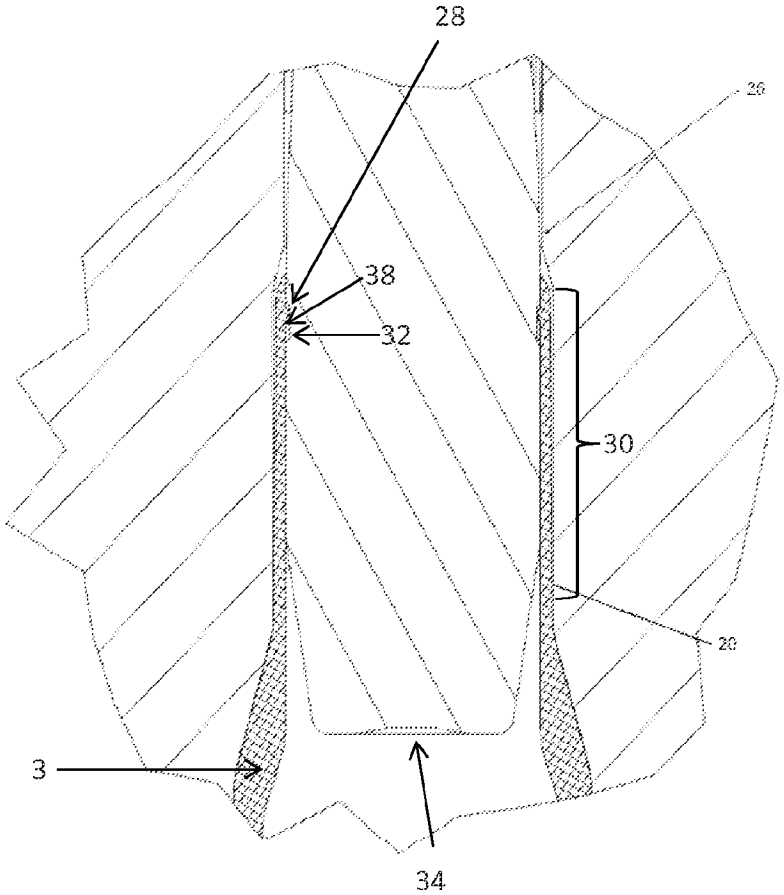
FIG. 3 provides a schematic of a polymeric ammunition casing incorporating a cylindrical polymeric strip within the internal cavity of the casing in accordance with embodiments of the invention.

In other embodiments a ledge or protrusion of polymeric material maybe disposed within the internal cavity of the casing to further improve the fit and integrity of polymeric ammunition casings. In such embodiments, as shown in FIG. 3, the casing (3) further comprises a strip of polymeric material having a generally cylindrical cross-section (28) and dimensioned to fit at least within the region of the neck portion (30) of the casing such that a ledge or region (28) of polymeric material is formed that protrudes into the internal cavity (38) of the casing at a position where the cannelure (32) of the projectile (34) will be disposed when the ammunition is assembled. Test firings of casing combining an extended neck and these cannelure reinforcing protrusions show particularly good results in comparison to polymeric cases following conventional dimensional standards or lacking such reinforcings. It will be understood that the cannelure reinforcing protrusions may be formed form the same or a different polymeric material from that at least partially forming the ammunition casing.

For the purposes of this disclosure, a "polymeric" ammunition casing refers to a casing wherein at least the neck portion and a portion of the body portion of the casing are formed from a polymeric material. Although any polymeric material suitable for use in ammunition articles, such as ammunition casings may be incorporated into embodiments of the casings, some exemplary materials include but are not limited to siloxane-modified Bisphenol-A polycarbonates (S-PC, for example, provided under the Trademark Lexan® EXL 9330 by General Electric Company-GE Plastics); polycarbonates containing biphenyl linkages (B-PC, for example, provided under the Trademark Makrolon® DP1-1848 by Bayer Polymers LLC of Pittsburgh Pa., and polyphenylsulfones (PPSU, for example, provided under the Trademark Radel® R-5700 NT, by Solvay Advanced Polymers, LLC of Alpharetta, Ga.). Additional, non limiting examples of suitable polymeric materials can be found in U.S. Pat. Nos. 8,240,252 and 8,813,650, each of which are incorporated herein by reference.

It should be generally understood throughout this patent and the above description that all items are attached to relevant adjacent items by some means commensurate with the materials of which they are. While the above description contains many specificities, these should not be construed as limitations on the scope of the invention, but rather as an exemplification of preferred embodiments thereof. Accordingly, the scope of the invention should be determined not by the embodiment(s), but by the appended claims and their legal equivalents.

What is claimed is:

1. A polymeric ammunition casing comprising:

a cylindrical hollow body defining an internal cavity formed at least partially of a polymeric material, the cylindrical hollow body further defining a longitudinal axis and having a primer end and a projectile end, wherein the body is formed of a body portion proximal to the primer end and a neck portion proximal to the projectile end, and wherein the diameter of the cylindrical hollow body tapers such that the diameter of the body portion is larger than the diameter of the neck portion; and wherein the longitudinal length of the neck portion of the polymeric ammunition casing is extended such that the overall length of the casing body is at least 0.003 inches greater than a maximum longitudinal length standard for an ammunition casing of identical caliber as set by at least one ammunition standards organization selected from the group consisting of the Sporting Arms and Ammunition Manufacturers' Institute and the Commission Internationale Permanente pour l'épreuve des armes à feu portatives.

2. The ammunition casing of claim 1, wherein the longitudinal length of the neck portion is elongated such that the polymeric ammunition casing exceeds a maximum longitudinal length standard for an ammunition casing of comparable caliber as set by at least one ammunition standards organization by at least 0.020 inches.

3. The ammunition casing of claim 1, wherein the longitudinal length of the neck portion is elongated such that the polymeric ammunition casing exceeds a maximum longitudinal length standard for an ammunition casing of comparable caliber as set by at least one ammunition standards organization by from at 0.050 inches.

4. The ammunition casing of claim 1, wherein the longitudinal length of the neck portion of the polymeric ammunition casing is elongated such that, when the ammunition casing is disposed within a firing chamber, the neck portion of the ammunition casing extends into the free bore portion of a firing chamber, but does not extend into the caliber-size portion of the firing chamber.

5. The ammunition casing of claim 1, wherein the ammunition casing has a caliber selected from the group of .22, .22-250, .223, .243, .25-06, .264, .270, .277, .300, .30-30, .30-40, 30.06, .303, .308, .357, .38, .40, .44, .45, .45-70, .50BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, and 40 mm.

6. The ammunition casing of claim 1, wherein at least the neck portion and a portion of the body portion are formed of a polymeric material.

7. The ammunition casing of claim 1, wherein the polymeric material is selected from the group consisting of siloxane-modified Bisphenol-A polycarbonates, polycarbonates containing biphenyl linkages, and polyphenylsulfones.

8. The ammunition casing of claim 1, further comprising a cylindrical strip of a polymeric material disposed within the internal cavity of the ammunition casing along at least a portion of the neck portion of said ammunition casing.

9. The ammunition casing of claim 8, wherein the cylindrical strip of polymeric material overlaps at least the portion of the neck portion of the ammunition casing that engages the cannelure of a projectile.

10. The ammunition casing of claim 8, wherein the cylindrical strip is formed of the same polymeric material as the ammunition casing.

11. A polymeric ammunition casing comprising:

a cylindrical hollow body defining an internal cavity formed at least partially of a polymeric material, the cylindrical hollow body further defining a longitudinal axis and having a primer end and a projectile end, wherein the body is formed of a body portion proximal to the primer end and a neck portion proximal to the projectile end, and wherein the diameter of the cylindrical hollow body tapers such that the diameter of the body portion is larger than the diameter of the neck portion;

wherein the longitudinal length of the neck portion of the polymeric ammunition casing is extended such that the overall length of the casing body is at least 0.003 inches greater than a maximum longitudinal length standard for an ammunition casing of identical caliber as set by at least one ammunition standards organization selected from the group consisting of the Sporting Arms and Ammunition Manufacturers' Institute and the Commission Internationale Permanente pour l'épreuve des armes à feu portatives; and further comprising a cylindrical strip of a polymeric material disposed within the internal cavity of the ammunition casing along at least the portion of the neck portion of said ammunition casing that engages the cannelure of a projectile.

12. The ammunition casing of claim 11, wherein the longitudinal length of the neck portion is elongated such that the polymeric ammunition casing exceeds a maximum longitudinal length standard for an ammunition casing of comparable caliber as set by at least one ammunition standards organization by at least 0.020 inches.

13. The ammunition casing of claim 11, wherein the longitudinal length of the neck portion is elongated such that the polymeric ammunition casing exceeds a maximum longitudinal length standard for an ammunition casing of comparable caliber as set by at least one ammunition standards organization by from at 0.050 inches.

14. The ammunition casing of claim 11, wherein the longitudinal length of the neck portion of the polymeric ammunition casing is elongated such that, when the ammunition casing is disposed within a firing chamber, the neck portion of the ammunition casing extends into the free bore portion of a firing chamber, but does not extend into the caliber-size portion of the firing chamber.

15. The ammunition casing of claim 11, wherein the ammunition casing has a caliber selected from the group of .22, .22-250, .223, .243, .25-06, .264, .270, .277, .300, .30-30, .30-40, 30.06, .303, .308, .357, .38, .40, .44, .45, .45-70, .50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, and 40 mm.

* * * * *